US011465188B2

(12) United States Patent
Zhai et al.

(10) Patent No.: US 11,465,188 B2
(45) Date of Patent: Oct. 11, 2022

(54) ROBOT FOR STRAIGHTENING DOUBLE THIN-WALL SECTION PIPE WITH UNDESIRABLY SHAPED CAVITIES

(71) Applicant: HEFEI UNIVERSITY OF TECHNOLOGY, Hefei (CN)

(72) Inventors: Hua Zhai, Hefei (CN); Yucheng Wu, Hefei (CN); Huaihao Song, Hefei (CN); Rui Lei, Hefei (CN); Shenglong Wang, Hefei (CN); Wenchao Shi, Hefei (CN)

(73) Assignee: HEFEI UNIVERSITY OF TECHNOLOGY, Hefei (CN)

( * ) Notice: Subject to any disclaimer, the term of this patent is extended or adjusted under 35 U.S.C. 154(b) by 294 days.

(21) Appl. No.: 16/903,006

(22) Filed: Jun. 16, 2020

(65) Prior Publication Data

US 2020/0406326 A1 Dec. 31, 2020

(30) Foreign Application Priority Data

Jun. 27, 2019 (CN) ..... 201910564919.6

(51) Int. Cl.

| | |
|---|---|
| ***B21D 3/16*** | (2006.01) |
| ***B21D 3/10*** | (2006.01) |
| ***B21D 1/08*** | (2006.01) |

(52) U.S. Cl.
CPC ..... *B21D 3/16* (2013.01); *B21D 1/08* (2013.01); *B21D 3/10* (2013.01)

(58) Field of Classification Search
CPC ... B21D 3/10; B21D 3/14; B21D 3/16; B21D 1/08; B21D 1/10; B21D 1/14
See application file for complete search history.

(56) References Cited

U.S. PATENT DOCUMENTS

2017/0175715 A1* 6/2017 Karesangannavar .... B21D 1/08

FOREIGN PATENT DOCUMENTS

CN 106140882 A * 11/2016 ..... B21D 1/10
CN 107716624 A * 2/2018 ..... B21D 3/16

* cited by examiner

*Primary Examiner* — Gregory D Swiatocha
(74) *Attorney, Agent, or Firm* — Hemisphere Law, PLLC; Zhigang Ma

(57) ABSTRACT

A robot for straightening double thin-wall section pipe with undesirably shaped cavities, includes two racks, a positioning component, a shaping component and a driving component. In operation, the double thin-wall section pipe is put in the positioning component, and the shaping component is used for shaping the pipe by the driving of the driving component. The robot improves the working efficiency, and is not only compact in structure design, stable in movement, precise in positioning and reliable in locking, but also convenient for disassembly and maintenance.

20 Claims, 2 Drawing Sheets

ROBOT FOR STRAIGHTENING DOUBLE THIN-WALL SECTION PIPE WITH UNDESIRABLY SHAPED CAVITIES

FIELD OF THE INVENTION

The present invention relates to robots for straightening pipe, and more particularly to a robot for straightening double thin-wall section pipe with undesirably shaped cavities.

BACKGROUND OF THE INVENTION

Currently, after the extrusion forming of the double thin-wall section pipe for aviation, due to uneven distribution of the material, the shape and size tolerance of the pipe seriously does not conform to the requirements of the design. And, the traditional shaping method is easy to cause greater internal stress on the pipe, resulting in the formation of bumps and depressions on the material surface. The pipe this has undesirably shaped cavities between the two thin walls of the pipe which do not satisfy manufacturing requirement and need to be corrected.

However, for the surface bumps, for example, rubber hammer and other tools are used to gently knock the bumps, but for the depressions, due to the small gap in the middle of the double thin-wall, ordinary tools cannot complete the shaping of the material surface sag, and the manual shaping takes a long time and low efficiency.

SUMMARY OF THE INVENTION

Therefore, the object of the present invention is to provide a robot for straightening double thin-wall section pipe with undesirably shaped cavities, which can simultaneously deal with the bumps and depressions, shorten the shaping time and improve the shaping efficiency, so as to ensure the shaping quality.

The present invention provides a robot for straightening double thin-wall section pipe with undesirably shaped cavities, including:

two racks, a beam and a horizontal shaft in parallel being set from top to bottom between the racks;

a positioning component, being set on the outside of the horizontal shaft and having a double-layer shell shaping area with an arched longitudinal section; the double thin-wall section pipe being located in the double-layer shell shaping area, and the beam being outside of the double-layer shell shaping area;

a shaping component, having a first telescopic part, a first tray, a second telescopic part and a second tray; the fixed end of the first telescopic part being movable mounted on the beam, and the telescopic end being connected to the first tray; the fixed end of the second telescopic part being movable mounted on the horizontal shaft, and the telescopic end being connected to the second tray; the first tray being able to suck or press on the outer wall of the double thin-wall section pipe, and the second tray being able to suck or press on the inner wall of the double thin-wall section pipe; and a driving component, for driving the first telescopic part to move in the axial direction of the beam, the second telescopic part to move in the axial direction of the horizontal shaft and the positioning component to rotate in the axial direction of the horizontal shaft.

In the robot of the present invention, the positioning component includes two fixed frames in parallel and a plurality of fixed rods; the fixed frames and the fixed rods are connected to form the double-layer shell shaping area.

In the robot of the present invention, the central parts of the fixed frames are set on the outside of the both ends of the horizontal shaft.

In the robot of the present invention, the both ends of the fixed rods are respectively inserted in the fixed frames.

In the robot of the present invention, the positioning component further includes two bearing housings; two bearing housings are set at the both ends of the horizontal shaft, the central parts of the fixed frames are respectively set on the outside of the bearing housings.

In the robot of the present invention, at least one extension is formed in the outer edge of one of the bearing housings, and a plurality of teeth are set on the inner wall of the extension.

In the robot of the present invention, the driving component includes a first motor and a gear meshed with the teeth; the first motor is mounted on one of the fixed frames, and the gear is mounted on the output shaft of the first motor.

In the robot of the present invention, each of the bearing housings has a bearing inside, the inner wall of the bearing is connected to the outer wall of the horizontal shaft.

In the robot of the present invention, the driving component includes a first frame body and a first driving structure; the first frame body has a first ferrule, and the first ferrule is on the beam; the top end of the first telescopic part is connected to the first frame body; the first driving structure is mounted on the first frame body, and used for driving the first ferrule to move in the axial direction of the beam.

In the robot of the present invention, a first hydraulic cylinder; the first hydraulic cylinder is connected to the first frame body, and the piston rod of the first hydraulic cylinder is connected the first tray.

In the robot of the present invention, the driving component includes a second frame body and a second driving structure; the second frame body has a second ferrule, and the second ferrule is on the horizontal shaft; the bottom end of the second telescopic part is connected to the second frame body; the second driving structure is mounted on the second frame body, and used for driving the second ferrule to move in the axial direction of the horizontal shaft.

In the robot of the present invention, the second telescopic part includes a second hydraulic cylinder; the second hydraulic cylinder is connected to the second frame body, and the piston rod of the second hydraulic cylinder is connected the second tray.

In the robot of the present invention, a shape correcting member is set in the first tray or the second tray, and the shape correcting member is used for shaping the double thin-wall section pipe.

In the robot of the present invention, each of the racks includes a plurality of guide posts; the guide posts of one of the racks are respectively inserted in the one end of the beam, the guide posts of the other of the racks are respectively inserted in the other end of the beam.

In the robot of the present invention, the driving component is used for driving the beam to move in the axial direction of the guide posts.

In the robot of the present invention, the driving component includes a plurality of third hydraulic cylinders; the piston rod of each of the third hydraulic cylinders is connected to each of the guide posts, and the third hydraulic cylinders are mounted on the both ends of the beam.

In the robot of the present invention, the both ends of each of the fixed rods run respectively through the fixed frames, and each end of each of the fixed rods is fixed by at least one nut.

In the robot of the present invention, the horizontal shaft is connected to the second frame body by a sliding key.

In the robot of the present invention, the shape correcting member is a suction cup or a platen, and the suction cup communicated with the external suction generating device through a pipe.

In the robot of the present invention, the both ends of the horizontal shaft are threaded and connected to the racks.

Solution of the present invention, for solving the above problem, is that apply the robot to shape the double thin-wall section pipe. The pipe can be located in the double-layer shell shaping area which provided by the positioning component, so that the first tray may touch the outer wall of the pipe, the second tray may touch the inner wall of the pipe. And, due to the driving component, the positioning component can be rotated and risen or fallen, the first tray and the second tray can be moved laterally, so that the tray may suck the depressions and press the bumps to reshape the wall of the pipe. By the shaping, the driving component not only realizes the automation of the housing reshaping correction, but also can accurately correct the deformation position of the reshaped housing, which improves the working efficiency. Therefore, the present invention is not only compact in structure design, stable in movement, precise in positioning and reliable in locking, but also convenient for disassembly and maintenance. In addition, it can reduce the weight and cost of the equipment.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

First Embodiment

Figure 1:
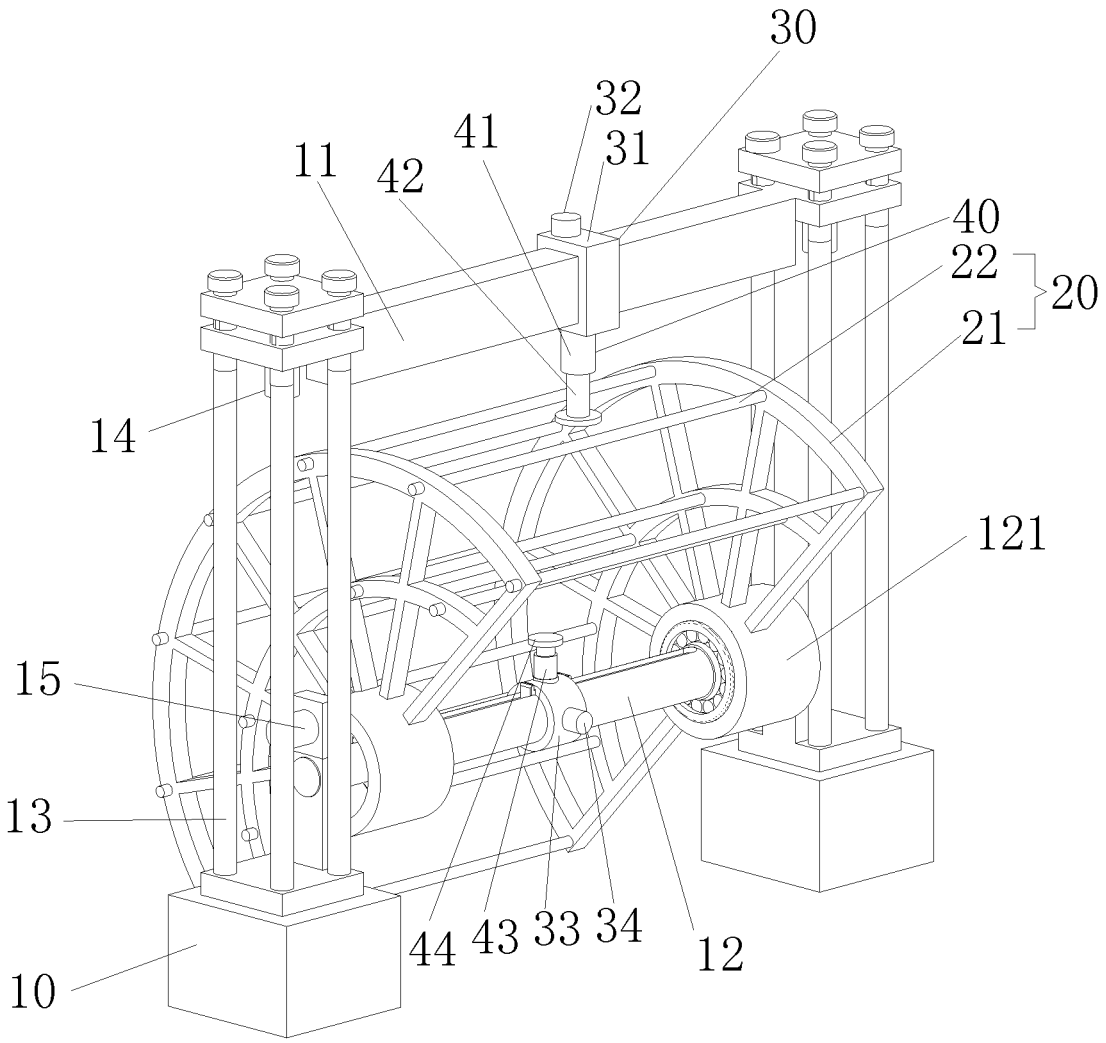
FIG. 1 is a stereogram of a robot for straightening double thin-wall section pipe with undesirably shaped cavities, according to an example embodiment.
Figure 2:
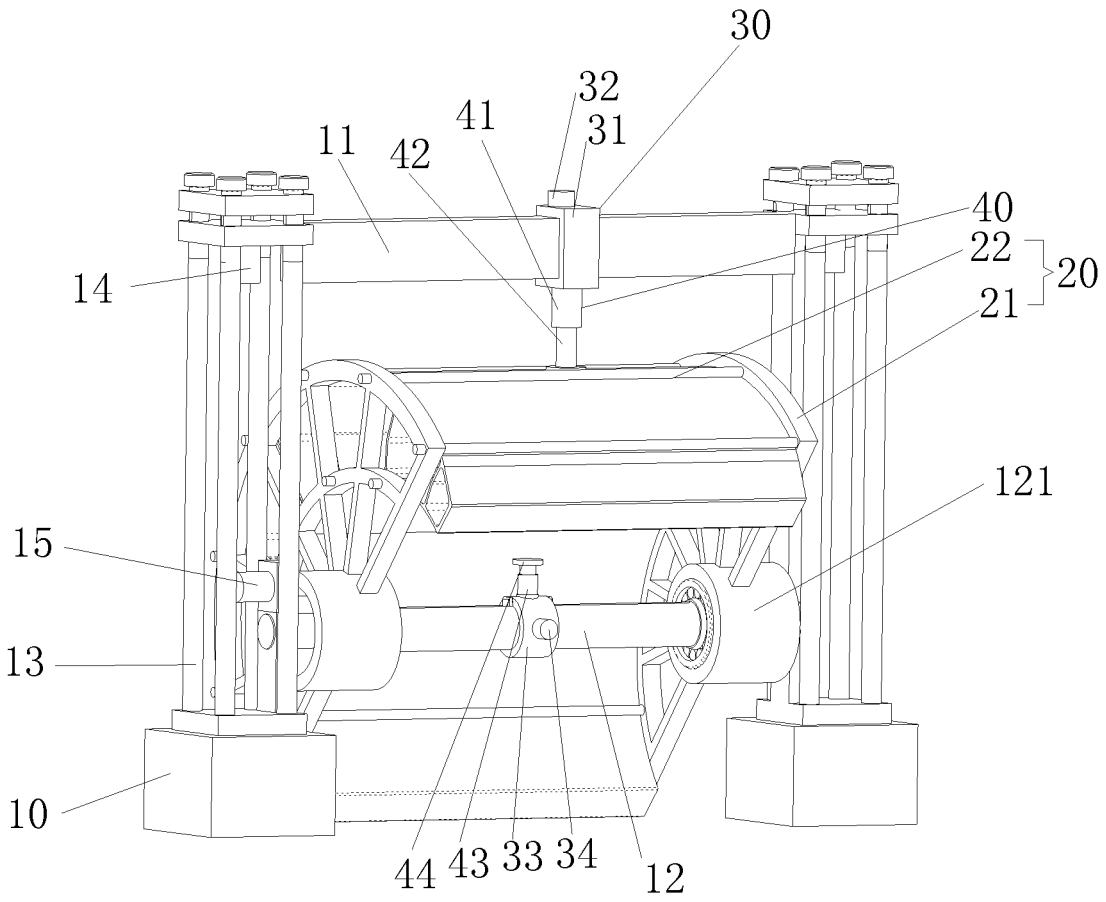
FIG. 2 is a stereogram of one of the perspectives of the robot of FIG. 1 after assembling the pipe to be rectified.

Referring to FIGS. 1 and 2, a robot for straightening double thin-wall section pipe with undesirably shaped cavities is partially shown as an embodiment. The robot includes two racks 10, a positioning component 20, a driving component 30 and a shaping component 40. The robot is a shaping device, and can be mounted in various places of pipe fitting shaping, and can deal with the pipe fitting with different damage degree, so that the inner and outer wall surface of the pipe can be restored to a complete surface.

The racks 10 are horizontally symmetrical and parallel. Each of the racks 10 is a frame structure with a vertical setting, and includes a plurality of guide posts 13 and a base of rectangular form. In this embodiment, the section of each of the guide posts 13 is a circular section, in other embodiments, the section may be a rectangular section. As long as the structural stability of the guide posts 13 is not affected, the guide posts 13 can also be another cylinder structure.

In this embodiment, the number of the guide posts 13 on each side is set to be four, and the four guide posts 13 are equally distributed in a rectangular manner and in parallel. In other embodiments, the number of the guide posts 13 can also be three, and the three guide posts 13 are distributed in a triangle. As long as the stability of the overall structure of the racks 10 is not affected, the number and arrangement of the guide posts 13 can be different.

A beam 11 and a horizontal shaft 12 in parallel are set from top to bottom between the racks 10. The beam 11 in this embodiment is a long cylindrical body with a circular section. But in other embodiments, as long as the structural stability of the beam 11 is not affected, it can also be other beam structure.

A plurality of column holes [[are]] is set in each of the both ends of the beam 11. The guide posts 13 of one of the racks 10 are respectively inserted in the one end of the beam 11 though some of the column holes, the guide posts 13 of the other of the racks 10 are respectively inserted in the other end of the beam 11 though the other of the column holes. The driving component 30 can be used for driving the beam 11 to move in the axial direction of the guide posts 13.

The horizontal shaft 12 in this embodiment is a long cylindrical body with a circular section. A plurality of axle holes is set in each of the racks 10, the both ends of the horizontal shaft 12 run respectively through the corresponding axle holes and are fixed on the racks 10 through nut tightening. The horizontal shaft 12 is connected to the second frame body 33 by a sliding key. The both ends of the horizontal shaft 12 are threaded and connected to the racks 10.

The positioning component 20 is set on the outside of the horizontal shaft 12 and has a double-layer shell shaping area with an arched longitudinal section. When the robot is in use, the double thin-wall section pipe is to be put in the double-layer shell shaping area, and the beam 11 is outside of the double-layer shell shaping area.

In this embodiment, the positioning component 20 includes two fixed frames 21 in parallel, a plurality of fixed rods 22 and two bearing housings 121. The fixed frames 21 are overall fan-shaped frames, and can be a semi-circular fan-shaped structure. The fixed frames 21 and the fixed rods 22 are connected to form the double-layer shell shaping area. The central parts of the fixed frames 21 are set on the outside of the both ends of the horizontal shaft 12. The both ends of the fixed rods 22 are respectively inserted in the fixed frames 21. The both ends of each of the fixed rods 22 run respectively through the fixed frames 21, and each end of each of the fixed rods 22 is fixed by at least one nut.

Two bearing housings 121 are set at the both ends of the horizontal shaft 12. The central parts of the fixed frames 21 are respectively set on the outside of the bearing housings 121. At least one extension is formed in the outer edge of one of the bearing housings 121, and a plurality of teeth are set on the inner wall of the extension. Each of the bearing housings 121 has a bearing inside, the inner wall of the bearing is connected to the outer wall of the horizontal shaft 12.

The shaping component 40 has a first telescopic part 41, a first tray 42, a second telescopic part 43 and a second tray 44. The fixed end of the first telescopic part 41 is movably connected on the beam 11, and the telescopic end is connected to the first tray 42. The fixed end of the second telescopic part 43 is movably connected on the horizontal shaft 12, and the telescopic end is connected to the second tray 44. The first tray 42 is able to suck or press on the outer wall of the double thin-wall section pipe, and the second tray 44 is able to suck or press on the inner wall of the double thin-wall section pipe.

A shape correcting member is set in the first tray 42 or the second tray 44, and the shape correcting member is used for shaping the double thin-wall section pipe. The shape correcting member is a suction cup or a platen, and the suction cup communicated with the external suction generating device through an external pipe. The shape correcting member is connected to the first tray 42 or the second tray 44 by screws respectively.

The driving component 30 is used for driving the first telescopic part 41 to move in the axial direction of the beam 11, the second telescopic part 43 to move in the axial direction of the horizontal shaft 12 and the positioning component 20 to rotate around the horizontal shaft 12. In this embodiment, the driving component 30 includes a first motor 15, a gear meshed with the teeth, a first frame body 31, a first driving structure 32, a second frame body 33, a second driving structure 34 and a plurality of third hydraulic cylinders 14.

The first motor 15 is mounted on one of the fixed frames 21, and the gear is mounted on the output shaft of the first motor 15. The first motor 15 drives the gear to rotate, and then the gear drives all the teeth to rotate, so that the bearing housings 121 drive the positioning component to rotate, to make the pipe rotate around the horizontal shaft 12.

The first frame body 31 has a first ferrule, and the first ferrule is on the beam 11. The top end of the first telescopic part 41 is connected to the first frame body 31. The first driving structure 32 is mounted on the first frame body 31, and used for driving the first ferrule to move in the axial direction of the beam 11. The first telescopic part 41 includes a first hydraulic cylinder. The first hydraulic cylinder is connected to the first frame body 31, and the piston rod of the first hydraulic cylinder is connected the first tray 42. The first driving structure 32 includes a second motor and a first directional wheel. The second motor is mounted on the first frame body 31, and the first directional wheel is mounted on the output shaft of the second motor. A first guide rail is set in the top of the beam 11, and the first directional wheel glides on the first guide rail.

The second frame body 33 has a second ferrule, and the second ferrule is on the horizontal shaft 12. The bottom end of the second telescopic part 43 is connected to the second frame body 33. The second driving structure 34 is similar to the first driving structure 32, structurally and functionally, and mounted on the second frame body 33, and used for driving the second ferrule to move in the axial direction of the horizontal shaft 12. The second telescopic part 43 includes a second hydraulic cylinder. The second hydraulic cylinder is connected to the second frame body 33, and the piston rod of the second hydraulic cylinder is connected the second tray 44. The second frame body 33 includes a third motor and a second directional wheel. The third motor is mounted on the second frame body 33, and the second directional wheel is mounted on the output shaft of the third motor. A second guide rail is set in the top of the horizontal shaft 12, and the second directional wheel glides on the second guide rail.

The piston rod of each of the third hydraulic cylinders 14 is connected to each of the guide posts 13, and the third hydraulic cylinders 14 are mounted on the both ends of the beam 11. In this embodiment, the number of the third hydraulic cylinders 14 is four and the third hydraulic cylinders 14 are arranged at the four vertices of a square. each of the third hydraulic cylinder 14 flexes its end so that the beam 11 can rise and fall, thus changing the distance between first tray 42 and the pipe, and adjusting the pressure or suction on the pipe.

Therefore, the working mode of the robot is as follows: the double thin-wall section pipe to be processed is placed in the double-layer shell shaping area, and the pipe is fixed through the fixed frames 21. Then the first motor 15 drive the bearing housings 121 to rotate around the horizontal shaft 12, the first frame body 31 under the driving of the first driving structure 32 along the beam 11 about, through this combination of movement can be positioned to the pipe on the upper surface of the depressions or bumps. For the depressions, replace the tray frame with the first tray 42. The suction cup is externally connected to the external suction generating device. The suction cup contacts the depressions on the upper surface of the pipe and recovers the depressions through suction. For the bumps, a pressure plate is replaced on the first tray 42. The pressure plate contacts the bumps on the upper surface of the pipe, and the pressure is restored through the elongation of the first telescopic part 41.

Similarly, for the depressions and bumps on the lower surface of the pipe, for depressions, the second tray 44 is replaced with suction cups. The suction cups are externally connected to the suction generating device. The suction cups contact with the depressions on the lower surface of the pipe and recover the depressions through suction. For the protuberance, the pressure plate is replaced on the second tray 44. The pressure plate contacts the protuberance on the lower surface of the pipe, and the protuberance is restored through the elongation of the second telescopic part 43. The robot has a very good effect on the modification of different upper and lower surfaces. It can more accurately locate the repaired area and improve work efficiency.

As described above, the pipe can be located in the double-layer shell shaping area which provided by the positioning component 20, so that the first tray 42 may touch the outer wall of the pipe, the second tray 44 may touch the inner wall of the pipe. And, due to the driving component 30, the positioning component 20 can be rotated and risen or fallen, the first tray 42 and the second tray 44 can be moved laterally, so that the tray may suck the depressions and press the bumps to reshape the wall of the pipe. By the shaping, the driving component 30 not only realizes the automation of the housing reshaping correction, but also can accurately correct the deformation position of the reshaped housing, which improves the working efficiency. Therefore, the present invention is not only compact in structure design, stable in movement, precise in positioning and reliable in locking, but also convenient for disassembly and maintenance. In addition, it can reduce the weight and cost of the equipment.

Second Embodiment

A robot for straightening double thin-wall section pipe with undesirably shaped cavities is shown as an embodiment. The robot is similar to the robot of the first embodiment, except the shaping component 40. The shaping component 40 has a first telescopic part 41, a first tray 42, a second telescopic part 43 and a second tray 44, and the first telescopic part 41 and the second telescopic part 43 are all electric telescopic rods. The electric telescopic rods can flex its free end to push or pull the first tray 42 and the second tray 44. In this way, the shaping component can be controlled more easily, and the pipe reshaping can be shaped simply by changing the electrical signals.

Third Embodiment

A robot for straightening double thin-wall section pipe with undesirably shaped cavities is shown as an embodiment. The robot is similar to the robot of the first embodiment, except the positioning component 20. The positioning component 20 further includes a buffer structure, the buffer structure has a plurality of elastic elements. The elastic elements are set in the double-layer shell shaping area, and connected to the fixed rods 22. The elastic elements may be some springs or rubber pads, they can provide buffering force to the pipe reshaping and prevent the pipe reshaping from being excessively shaped.

Fifth Embodiment

A robot for straightening double thin-wall section pipe with undesirably shaped cavities is shown as an embodiment. The robot is similar to the robot of the first embodiment, except the racks 10. The racks 10 further includes a plurality of limit tabs. The limit tabs are set on the outer wall of the guide posts 13, and used for limiting the displacement of the beam 11. In this way, the beam 11 cannot rise or fall too much to cause damage to the pipe.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A robot for straightening double thin-wall section pipe with undesirably shaped cavities, comprising:

two racks;

a beam and a horizontal shaft in parallel being set from top to bottom between the racks;

a positioning component, being set on the outside of the horizontal shaft and having a double-layer shell shaping area with an arched longitudinal section and configured to receive the double thin-wall section pipe; and the beam being outside of the double-layer shell shaping area;

a shaping component, having a first telescopic part, a first tray, a second telescopic part and a second tray; the fixed end of the first telescopic part being movably connected on the beam, and the telescopic end being connected to the first tray; the fixed end of the second telescopic part being movably connected on the horizontal shaft, and the telescopic end being connected to the second tray; the first tray being able to suck or press on the outer wall of the double thin-wall section pipe, and the second tray being able to suck or press on the inner wall of the double thin-wall section pipe; and a driving component, for driving the first telescopic part to move in the axial direction of the beam, the second telescopic part to move in the axial direction of the horizontal shaft and the positioning component to rotate in the axial direction of the horizontal shaft.

2. The robot according to claim 1, wherein the positioning component comprises two fixed frames in parallel and a plurality of fixed rods; the fixed frames and the fixed rods are connected to form the double-layer shell shaping area.

3. The robot according to claim 2, wherein the central parts of the fixed frames are set on the outside of the both ends of the horizontal shaft.

4. The robot according to claim 2, wherein the both ends of the fixed rods are respectively inserted in the fixed frames.

5. The robot according to claim 2, wherein the positioning component further comprises two bearing housings; the two bearing housings are set at the both ends of the horizontal shaft, the central parts of the fixed frames are respectively set on the outside of the bearing housings.

6. The robot according to claim 5, wherein at least one extension is formed in the outer edge of one of the bearing housings, and a plurality of teeth are set on the inner wall of the extension.

7. The robot according to claim 6, wherein the driving component comprises a first motor and a gear meshed with the teeth; the first motor is mounted on one of the fixed frames, and the gear is mounted on the output shaft of the first motor.

8. The robot according to claim 5, wherein each of the bearing housings has a bearing inside, the inner wall of the bearing is connected to the outer wall of the horizontal shaft.

9. The robot according to claim 2, wherein the both ends of each of the fixed rods run respectively through the fixed frames, and each end of each of the fixed rods is fixed by at least one nut.

10. The robot according to claim 1, wherein the driving component comprises a first frame body and a first driving structure; the first frame body has a first ferrule, and the first ferrule is on the beam; the top end of the first telescopic part is connected to the first frame body; the first driving structure is mounted on the first frame body, and used for driving the first ferrule to move in the axial direction of the beam.

11. The robot according to claim 10, wherein the first telescopic part comprises a first hydraulic cylinder; the first hydraulic cylinder is connected to the first frame body, and the piston rod of the first hydraulic cylinder is connected the first tray.

12. The robot according to claim 1, wherein the driving component further comprises a second frame body and a second driving structure; the second frame body has a second ferrule, and the second ferrule is on the horizontal shaft; the bottom end of the second telescopic part is connected to the second frame body; the second driving structure is mounted on the second frame body, and used for driving the second ferrule to move in the axial direction of the horizontal shaft.

13. The robot according to claim 12, wherein the second telescopic part comprises a second hydraulic cylinder; the second hydraulic cylinder is connected to the second frame body, and the piston rod of the second hydraulic cylinder is connected the second tray.

14. The robot according to claim 12, wherein the horizontal shaft is connected to the second frame body by a sliding key.

15. The robot according to claim 1, wherein a shape correcting member is set in the first tray or the second tray, and the shape correcting member is used for shaping the double thin-wall section pipe.

16. The robot according to claim 15, wherein the shape correcting member is a suction cup or a platen, and the suction cup communicated with the external suction generating device through a pipe.

17. The robot according to claim 1, wherein each of the racks comprises a plurality of guide posts; the guide posts of one of the racks are respectively inserted in the one end of the beam, the guide posts of the other of the racks are respectively inserted in the other end of the beam.

18. The robot according to claim 17, wherein the driving component is used for driving the beam to move in the axial direction of the guide posts.

19. The robot according to claim 18, wherein the driving component comprises a plurality of third hydraulic cylinders; the piston rod of each of the third hydraulic cylinders is connected to each of the guide posts, and the third hydraulic cylinders are mounted on the both ends of the beam.

20. The robot according to claim 1, wherein the both ends of the horizontal shaft are threaded and connected to the racks.

* * * * *